US007748802B2

(12) United States Patent
Peruzzi

(10) Patent No.: US 7,748,802 B2
(45) Date of Patent: Jul. 6, 2010

(54) FILING CABINET

(76) Inventor: Victor Mario Peruzzi, 12136 Palisades Dr., Dunkirk, MD (US) 20754

( * ) Notice: Subject to any disclaimer, the term of this patent is extended or adjusted under 35 U.S.C. 154(b) by 934 days.

(21) Appl. No.: 11/400,173

(22) Filed: Apr. 10, 2006

(65) Prior Publication Data

US 2007/0236117 A1 Oct. 11, 2007

(51) Int. Cl.
*A47B 88/00* (2006.01)

(52) U.S. Cl. ..... 312/351; 312/248; 312/183; 211/96; 211/195

(58) Field of Classification Search ..... 211/46, 211/87.01, 96, 104, 99, 168, 169, 189, 195, 211/184, 175; 312/245, 246, 248, 351, 183, 312/184, 185, 191
See application file for complete search history.

(56) References Cited

U.S. PATENT DOCUMENTS 546,647 A * 9/1895 Barnes ..... 312/184
1,415,307 A * 5/1922 Bullock ..... 312/9.59
1,456,446 A * 5/1923 Hotaling ..... 211/50
1,715,078 A * 5/1929 Whyte et al. ..... 211/50
2,062,802 A * 12/1936 Walker ..... 211/44
2,197,355 A * 4/1940 Ulrich ..... 312/184
2,198,183 A * 4/1940 Soderlund ..... 40/391
2,778,705 A * 1/1957 Barker ..... 312/313
2,950,541 A * 8/1960 Dement ..... 34/238
4,136,622 A * 1/1979 Bue et al. ..... 108/48
4,410,093 A * 10/1983 Chiariello et al. ..... 211/11
4,682,697 A * 7/1987 Cohen ..... 211/45
5,437,379 A * 8/1995 Wolf et al. ..... 211/169
6,510,954 B2 * 1/2003 Reddig ..... 211/162
2005/0092698 A1 * 5/2005 Stravitz ..... 211/11

* cited by examiner

*Primary Examiner*—Darnell M Jayne
*Assistant Examiner*—Dan Rohrhoff

(57) ABSTRACT

A rack mounted inside a cabinet in which a number of office files are supported, wherein the rack can be extended outward of the cabinet allowing all of the files to be visibly seen for easy identification along with the easy removal of any file. The files are supported one above the other so that each file tab is higher than the lower one.

The rack is shaped to fit inside a cabinet that is substantially as tall and as wide as a conventional filing cabinet but is thinner and capable of being wall mounted and thereby consuming a minimum amount of floor space.

3 Claims, 3 Drawing Sheets

FILING CABINET

BACKGROUND OF THE INVENTION

A conventional filing cabinet normally consists of a plurality of deep drawers that are pulled out into a room and the files are stored one behind the other. Each file is placed in an expensive file hanger wherein the file hanger slides on a pair of rails which allow the user to move each file laterally to locate the file that is desired. The entire file including the tab is sometimes obscured from view until the user moves the front of the file hanger laterally and away from the file to make a positive identification before removing the desired file. In returning the file to its file hanger, the process of finding the proper file hanger is repeated by sliding the file hangers, opening the proper one and placing the file back. This is a time consuming process and frequently causes misfiling. This invention overcomes this process because each file is placed in its own slot one above the other wherein each file tab is visible to the user's eye. The desired file can be located without touching the file. It is easily removed and replaced virtually without misfiling.

Also, the individual slots are equally spaced. If a thicker file space is needed a wire loop can be easily removed to accommodate a file of a larger thickness.

Further, this filing cabinet is thin in depth and can be wall mounted adapting well to limited floor space at home or office.

FIELD OF INVENTION

This invention relates to a vertical filing system comprising a rack having a number of slots each supporting objects such as manila folders whereby the tab of each folder is above the top edge of the lower folder. When the vertical rack, that is supported inside a cabinet, is extended outward the folders become situated substantially vertical and easily visible to the user. This configuration utilizes a minimum amount of floor space when closed.

The unit can be wall or floor supported and the cabinet does not have a bulky filing cabinet appearance.

Until the present invention, there were no truly effective devices for storing manila folders in a thin cabinet to save floor space and to allow the user to view all of the tabs on folders without physically pulling through them. Also each folder is easily returned thus minimizing misfiling.

The use of costly PENDAFLEX ®folders is eliminated and legal or letter size folders can be stored in the same cabinet.

It is an object of the present invention to provide a vertical file assembly where each compartment or slot supports a single folder whereby each folder is positioned for instant visual recognition and retrieved without physically searching through the entire rack of folders. It is another object of the present invention to eliminate misfiling when one file is removed from the rack.

A further object is to store folders using a minimal amount of floor space especially in home or small offices with cubicals.

Yet another object of the invention is to give latitude to a furniture designer to style the door of this cabinet to fit any decor and not necessarily look like a typical filing cabinet.

Another object of the invention is to allow the user to retrieve a file without sliding other files in a drawer and without opening and closing a heavy drawer full of files or bending down to retrieve a file from a bottom drawer.

DESCRIPTION OF THE PREFERRED EMBODIMENT

Figure 1:
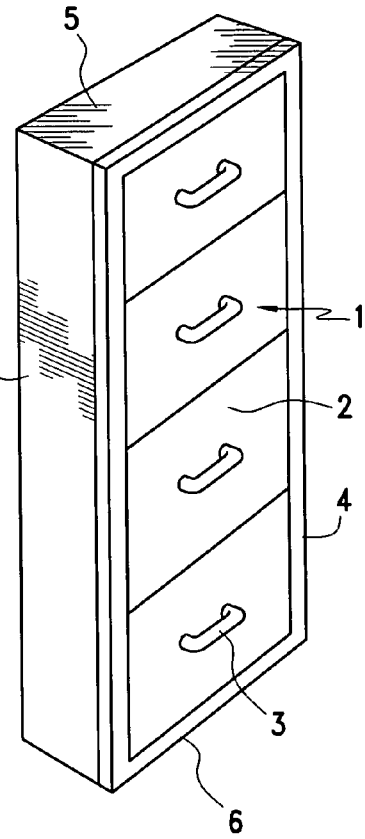
FIG. 1 is a perspective view of a filing cabinet with a closed door.

FIG. 1 shows a filing cabinet 1 which can be wall mounted comprising a door 2, handles 3, sides 4, top 5, and bottom 6.

Figure 2:
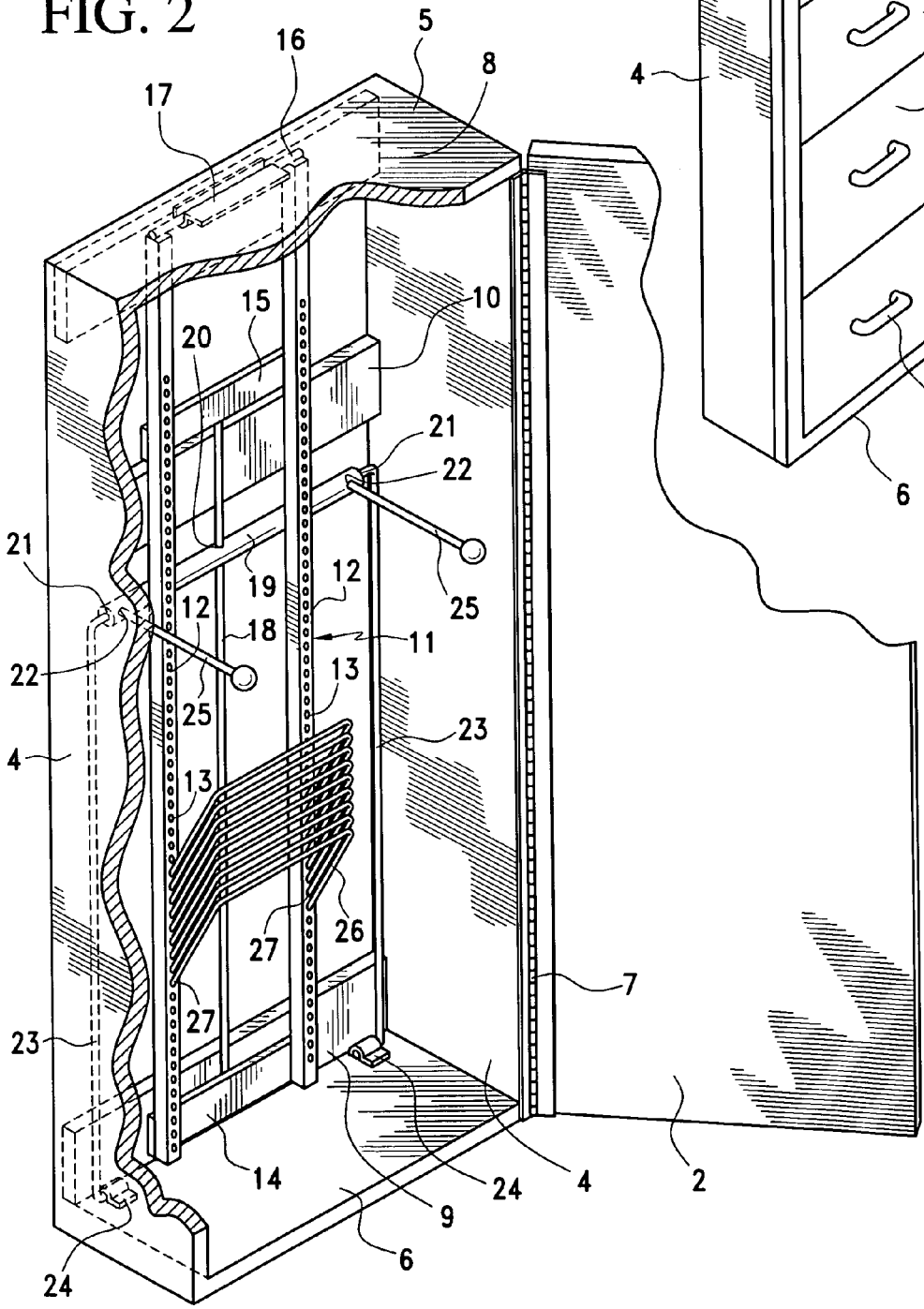
FIG. 2. is a perspective view of the filing cabinet with an open door and showing a vertical rack.

FIG. 2 shows door 2 opened and attached to one side 4 by a hinge 7. Back support 8, is attached to sides 4 and top 5. Back support 9 is attached to sides 4 and bottom 6. Back support 10 is attached to sides 4 above the midway point of the cabinet.

Figure 4:
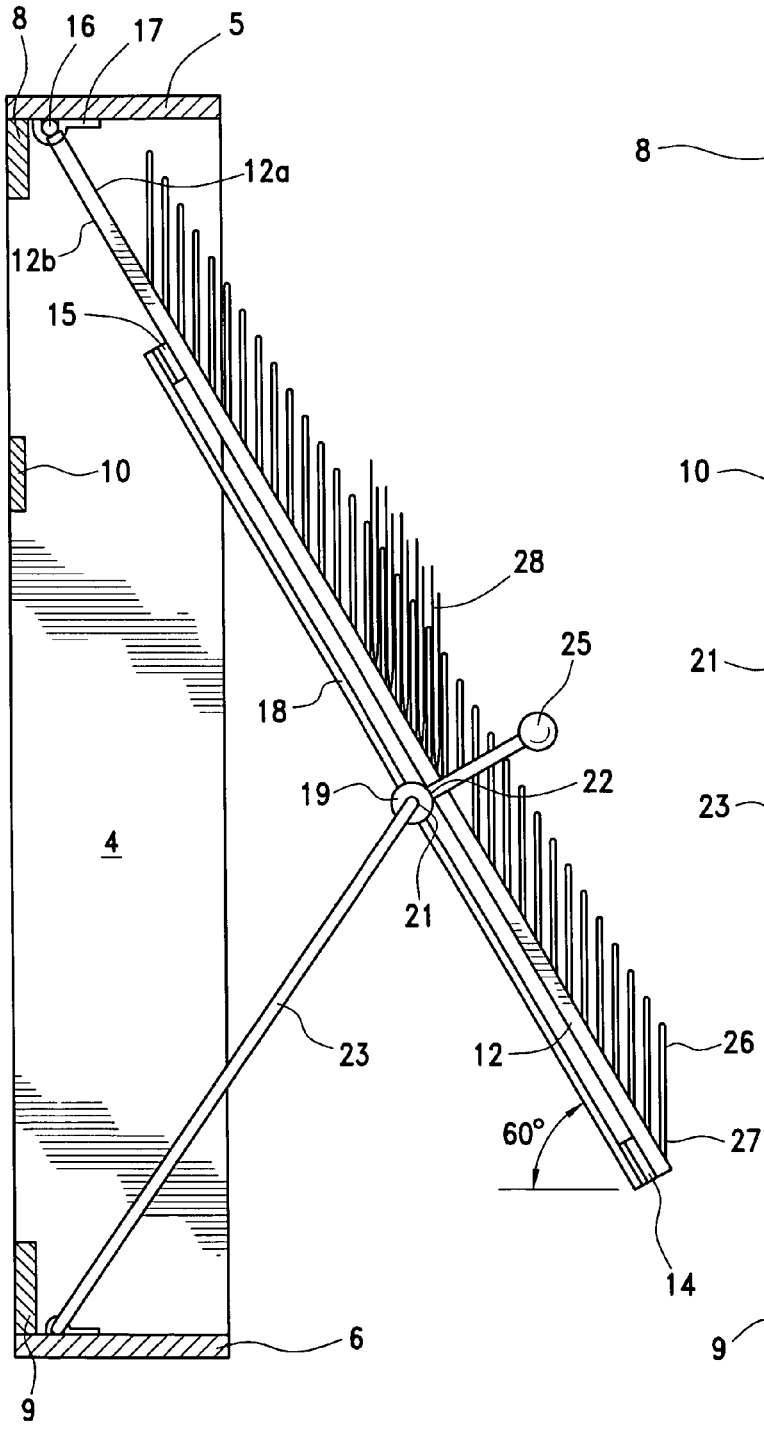
FIG. 4 shows the vertical rack in the open position supporting removable loops and partially filled with files.

FIG. 4 shows rack 11 comprises of two horizontally spaced vertical extending tubular side rails 12 and each tubular side rail having a front side 12A and rear side 12B. Tubular side rails 12 have a plurality of equally vertically spaced holes 13 starting at the bottom to nearly its upper end of tubular side rails 12. Holes 13 are drilled only into front side 12A at an angle of 30 degrees to tubular side rails 12. Tubular side rails 12 are attached to each other by a horizontal bottom brace 14 and brace 15 located above back support 10. Rod 16 connects side rails 12 at the upper end.

A hinge 17 is attached to the bottom side of top 5 and pivotally supports rod 16. A vertical guide rod 18 is attached to bottom brace 14 and brace 15. A transverse sliding member 19 comprises a drilled hole 20 midway between its ends whereby rod 18 freely slides through. Each end of transverse sliding member 19 is provided with an opening 21. The ends of transverse sliding member 19 also have openings 22 drilled perpendicular to its axis.

U shaped legs 23 are pivotally attached at their lower ends to hinges 24 and hinges 24 are attached to the inside of bottom 6. The upper ends of U shaped legs 23 are pivotally positioned into openings 21.

Figure 5:
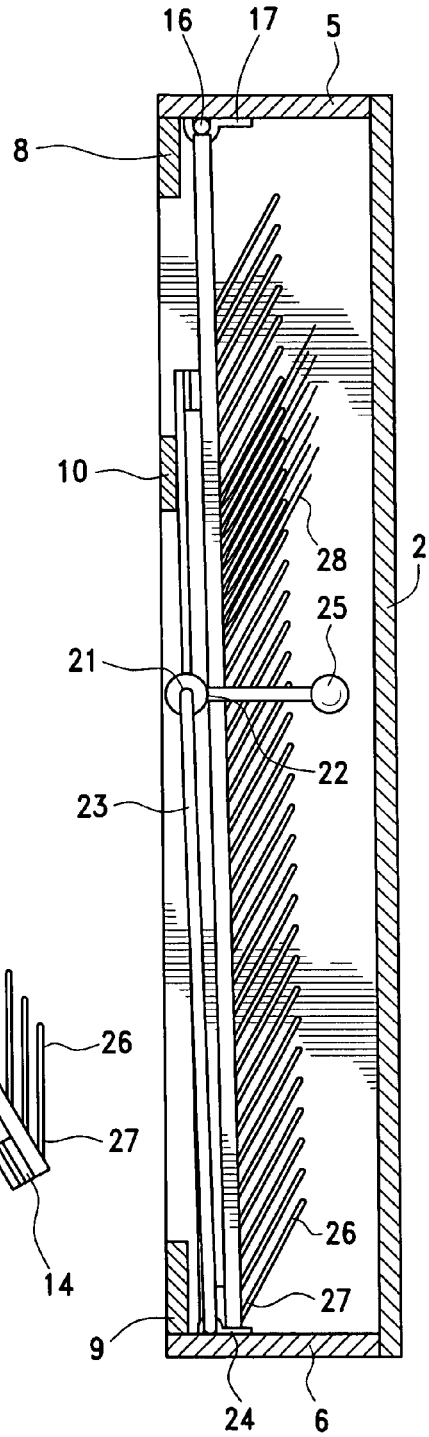
FIG. 5 shows the vertical rack in the closed position.

Handles 25 are fixed within openings 22 and project forward towards door 2 but remaining within the walls of the cabinet 1 as shown in FIG. 5.

Figure 3:
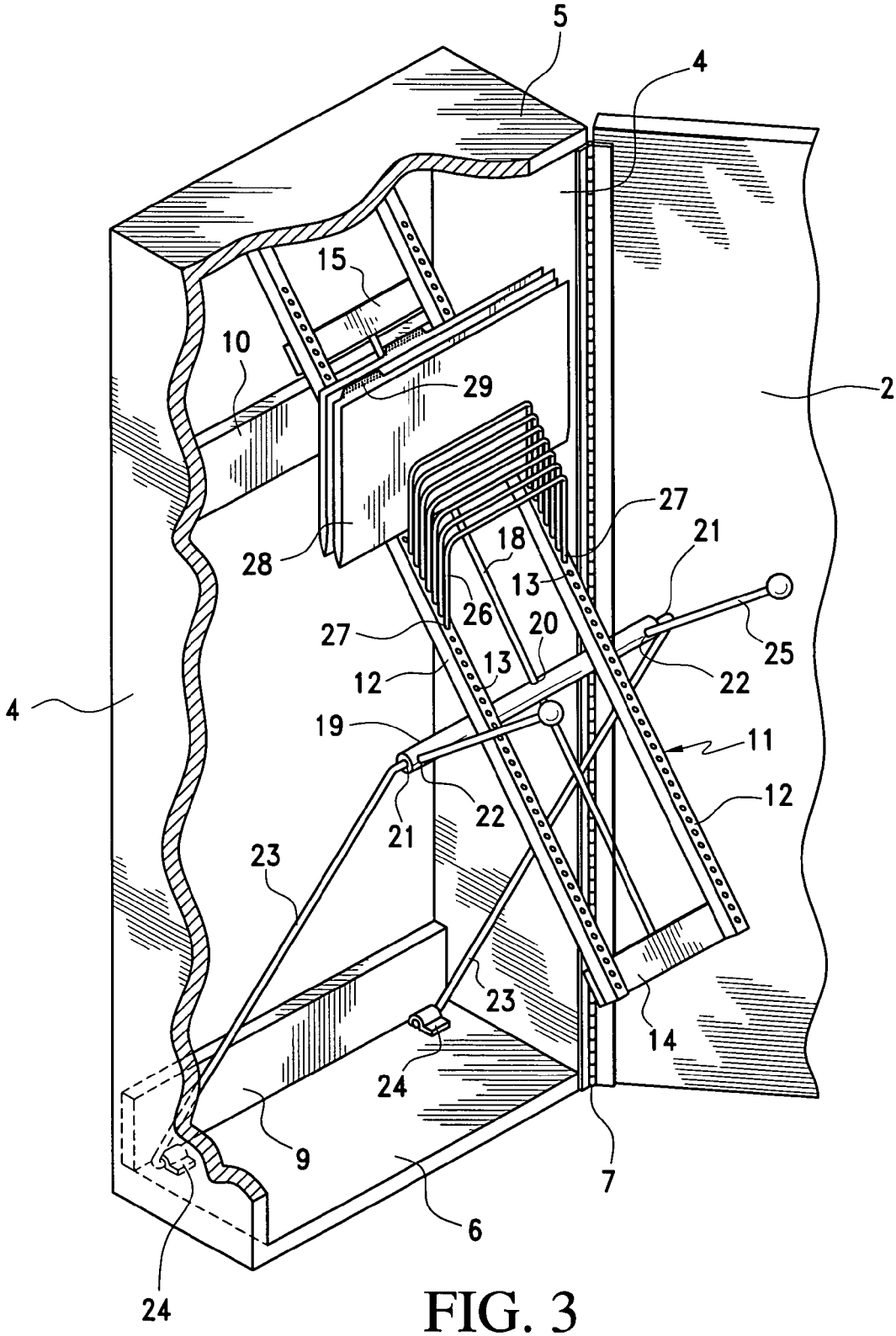
FIG. 3. is a perspective view of the filing cabinet with the door open and the vertical rack extended out of the cabinet partially filled with files.

U shaped loops 26 comprise of a U shaped form having the same width as rack 11, wherein straight legs 27 of loops 26 fit snugly into holes 13 for easy removal. Loops 26 have an upper bight portion 26A. Straight legs 27 project into tubular side rails 12 until they rest on the inside wall of backside 12B. Wire loops 26 are now vertically spaced to support office files 28 and folder tabs 29 shown in FIGS. 3, 4, and 5 permitting wire loops 26 to be easily removed, thus any loop 26 can be removed to make the space larger between two other loops 26 to accommodate a thicker file.

In operation, the door 2 is opened, the user takes hold of the handles 25 and gently pulls the handles outwardly and downwardly until the transverse sliding member 19 slides on the backsides 12B of tubular side rails 12 while legs 23 pivot within openings 21 and within hinges 24 and transverse sliding member moves downwardly along guide rod 18. When fully opened rack 11 is now approximately at an angle of 60 degrees from the floor, see FIG. 4. Files 28 are now substantially in a perpendicular position relative to the floor. Now file tabs 29 are all visible to the user's eye and the desired file is easily identified. The desired file is easily removed and returned to the rack virtually avoiding misfiling since each file has its own slot.

Lastly the user lifts handles 25 upwardly and inwardly. The transverse sliding member 19 slides up the back sides 12B of tubular side rails 12 and upwardly along guide rod 18 while legs 23 again pivot within openings 21 and within hinges 24 until rack 11 is in its closed position.

I claim:

1. A vertical filing system, the combination of a cabinet having side, top and bottom walls, a back support and a front door for closing said cabinet, a rack having a pair of parallel vertically extending horizontally spaced means, comprising of rails with upper and lower ends and front and rear sides, hinge means connecting the upper ends and said rails to the top of the cabinet, said rails disposed vertically at the back support when in a closed vertical position, leg means, handle means and transverse sliding means being integrally connected to each other and said sliding transverse means solely making contact with the rear sides of said rails, said leg means having upper and lower ends, said lower ends connected to the lower end of the cabinet near the back support, said upper ends connected to said handle means and said transverse sliding means, said transverse sliding means being in sliding contact downwardly against the rear sides of said rails thereby moving said rails from the closed vertical position to an open angular position, said handle means spaced away and to the sides of said rails, a plurality of vertically spaced file support means being disposed angularly upwardly and outwardly relative to the front sides of the rails.

2. A vertical filing system according to claim 1, said front sides of the rails having a plurality of vertically spaced holes, said plurality of vertically spaced file support means comprising of U-shaped loops with legs, said legs being inserted into said vertically spaced holes and abutting the rear sides of said rails.

3. A vertical filing system according to claim 2 wherein said U-shaped loops are removably inserted into said respective holes located on said rails.

* * * * *